US006556147B1

(12) United States Patent
Fisher et al.

(10) Patent No.: US 6,556,147 B1
(45) Date of Patent: Apr. 29, 2003

(54) PYLON WITH INTERNAL LIGHTING

(76) Inventors: William R. Fisher, R.R. #2, Crossfield, Alberta (CA), T0M 0S0; Ronald D. McNiven, 6201-15 Grier Place N/E, Calgary, Alberta (CA), T2K 5Y5; Biagio Magliocca, 31 Hampstead Point, Calgary, Alberta (CA), T3A 6E9

( * ) Notice: Subject to any disclaimer, the term of this patent is extended or adjusted under 35 U.S.C. 154(b) by 0 days.

(21) Appl. No.: 09/634,594

(22) Filed: Aug. 8, 2000

(51) Int. Cl.[7] ..... G08G 1/095

(52) U.S. Cl. ..... 340/908; 340/908.1; 340/471; 362/183; 320/5; 116/63 R; 116/63 P; 116/63 C

(58) Field of Search ..... 340/473, 907, 340/908, 908.1, 471, 321, 332; 116/63 R, 63 P, 63 C; 362/190, 191, 186, 158; 40/612; 307/150; 320/5, 14, 30

(56) References Cited

U.S. PATENT DOCUMENTS

| | | | | |
|---|---|---|---|---|
| 3,132,624 A | | 5/1964 | Shoemaker | 116/63 R |
| 4,613,847 A | * | 9/1986 | Scolari et al. | 340/332 X |
| 4,739,302 A | | 4/1988 | Kinard | 340/908.1 |
| 5,294,925 A | | 3/1994 | Dydzyk | 341/50 |
| 5,521,595 A | | 5/1996 | Totten et al. | 340/908 |
| 5,577,824 A | | 11/1996 | Wright | 340/908.1 |
| 5,754,124 A | * | 5/1998 | Daggett et al. | 340/908.1 |

* cited by examiner

*Primary Examiner*—Daryl Pope
(74) *Attorney, Agent, or Firm*—I. Zbororvsky

(57) ABSTRACT

Highway safety markings around construction sites are of the utmost importance to both the driver and the worker, and traffic pylons have become a common method of channeling traffic away from hazards or into desired travel lanes. At night, however, these pylons become hard to see in unlighted areas, and their illumination is highly desirable. One method of providing illumination that is commonly used in highway barriers is a battery powered light mounted to the top of a pylon or trestle type barrier. However the additional weight of a light unit mounted at the top of a relatively light weight traffic pylon makes the pylon, which is already subject to tipping by wind or impact by vehicles, more top heavy and subject to tip over. The present invention overcomes this obstacle by placing the light source in the base of the pylon, providing additional stability and illuminating it from within, while also providing the light source with protection from the elements.

7 Claims, 4 Drawing Sheets

PYLON WITH INTERNAL LIGHTING

BACKGROUND OF THE INVENTION

1. Field of the Invention

The present invention relates to the field of traffic safety and night time warning lighting for highway hazard areas. More particularly, the invention comprises a traffic pylon with a light source mounted in its base such that the light shining up through the pylon illuminates it from within, making it more visible to the motorist.

2. Description of the Prior Art

Highway safety markings around construction sites are of the utmost importance to both the driver and the worker, and safety pylons have become a common method of channeling traffic away from hazards or into desired travel lanes. At night, however, these pylons become hard to see in unlighted areas, arid their illumination is highly desirable. A number of improvements in lighting traffic pylons have been made, including;

U.S. Pat. No. 5,577,824, issued to Barry T. Wright on Nov. 26, 1996, relates to a traffic cone mounted warning light, in which one or more light emitting heads and a comparable number of power source packs are mounted at the apex of a traffic cone. Due to their light weight construction, traffic cones are prone to being knocked over due to winds or by being grazed by passing traffic, and unlike the present invention, Wright places additional weight at the apex of the cone, making the cone more susceptible to knock over. Additionally, unlike the present invention, Wright's illumination is directional, requiring more exact placement of the cone.

U.S. Pat. No. 4,294,924, issued to Dmytro Dydzyk on Mar. 15, 1994, relates to a flashing warning light for a traffic control device in which a conically shaped, battery powered beacon fits over the apex of a traffic cone or to a trestle type barrier. Illumination is in a 360° arc, but again, in a traffic cone application, the light adds weight to the top of the cone, increasing the likelihood of toppling the cone, unlike the present invention.

U.S. Pat. No. 5,521,595, issued to George L. Totten, et. al. on May 28, 1996, relates to an illuminated hazard warning device. Totten presents a totally self-contained hazard warning light and pylon, providing a 360° arc of illumination, but unlike the present invention, Totten requires the expense of procuring and maintaining a full system, not just the lighting beacon.

U.S. Pat. No. 4,739,302, issued to Noel S. Kinard on Apr. 19, 1988, relates to a road construction barrier/marker. Generally conical in shape, Kinard is rounded and weighted at its base, allowing for self righting in the event of knock over. A battery is located in the base of the unit, with a light at the apex providing a 360° arc of illumination. Unlike the present invention, Kinard requires the expense of procuring and maintaining a full system, not just the lighting beacon.

U.S. Pat. No. 3,132,624, issued to Charles Shoemaker, Jr., on May 12, 1964 relates to a collapsible signal device intended primarily for use as a compact emergency warning device for motorists in an automotive breakdown situation. Shoemaker presents a rigid base plate with a cloth cone supported by a conical compression spring which is naturally disposed to an extended position. The cone can be collapsed by compressing the spring. A reflector mounted at the apex of the cone provides added visibility and a battery powered light unit mounted in the base illuminates the cone from within. Unlike the present invention, however, Shoemaker is not of sufficient durability to be used as a highway warning marker for an extended period.

None of the above inventions and patents, taken either singly or in combination, is seen to describe the instant invention as claimed.

SUMMARY OF THE INVENTION

Highway safety markings around construction sites are of the utmost importance to both the driver and the worker, and traffic pylons have become a common method of channeling traffic away from hazards or into desired travel lanes. At night, however, these pylons become hard to see in unlighted areas, and their illumination is highly desirable. One method of providing illumination that is commonly used in highway barriers is a battery powered light mounted to the top of a pylon or trestle type barrier. However the additional weight of a light unit mounted at the top of a relatively light weight traffic pylon makes the pylon, which is already subject to tipping by wind or impact by vehicles, more top heavy and more easily subject to tip over. The present invention overcomes this obstacle by placing the light unit in the base of the pylon, providing additional stability and illuminating it from within.

Accordingly, it is a principal object of the invention to provide a traffic pylon which is economical.

It is another object of the invention to provide a traffic pylon which is highly visible by day.

It is a further object of the invention to a traffic pylon which is illuminated for added visibility by night.

Still another object of the invention is to provide a traffic pylon which is more stable and less prone to tip over.

An additional object of the invention is to provide an illuminated traffic pylon which is easy to maintain.

It is again an object of the invention to provide an illuminated traffic pylon which is durable.

Yet another object of the invention is to provide an illuminated traffic pylon which is light weight.

Still another object of the invention is to provide an illuminated traffic pylon in which the source of illumination can be automatically activated.

Another object of the invention is to provide an illuminated traffic pylon in which the source of illumination may be set in a flashing mode.

Yet another object of the invention is to provide an illuminated traffic pylon in which the source of illumination is protected from the elements.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
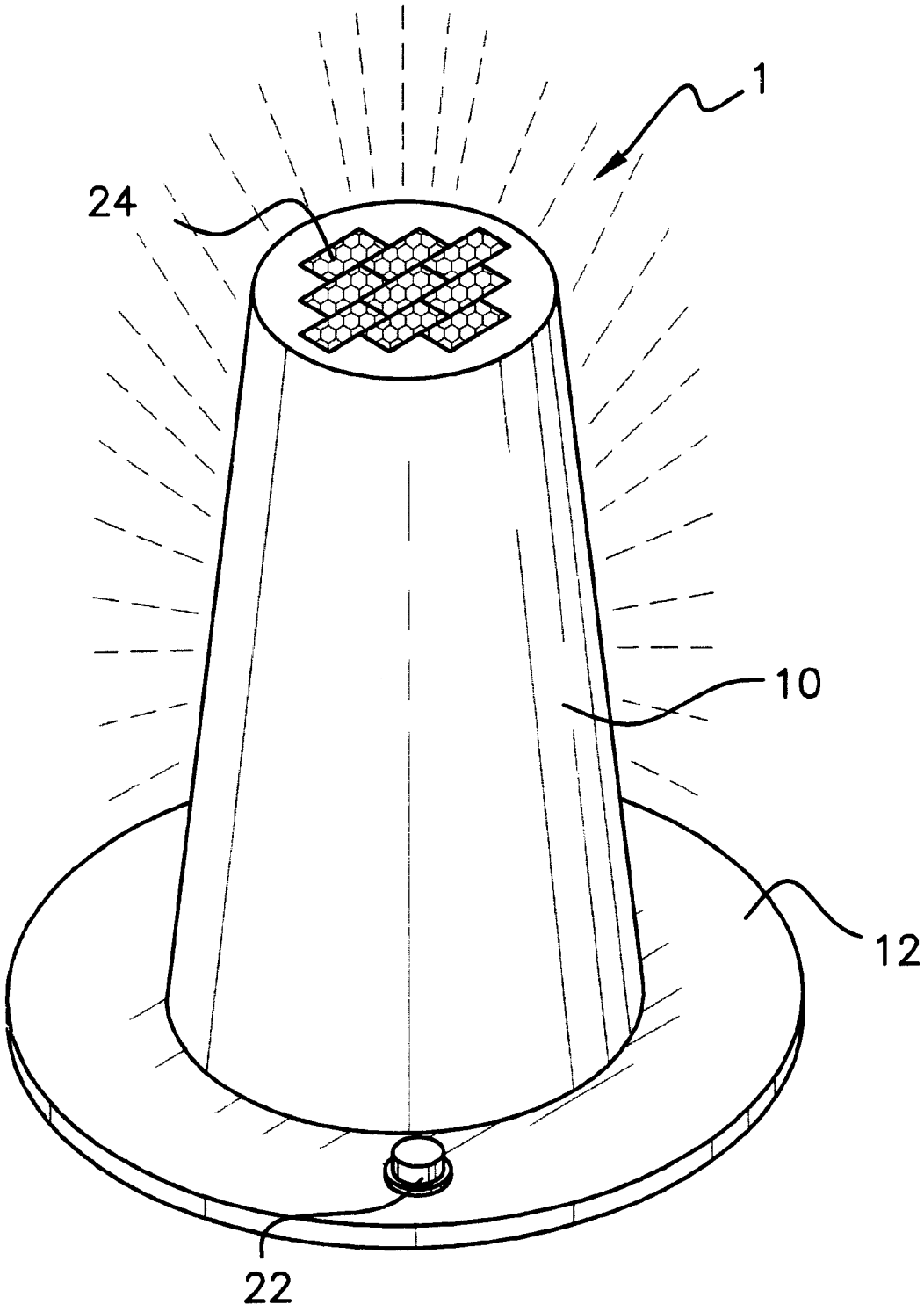
FIG. 1 is an environmental perspective of the invention.
Figure 2:
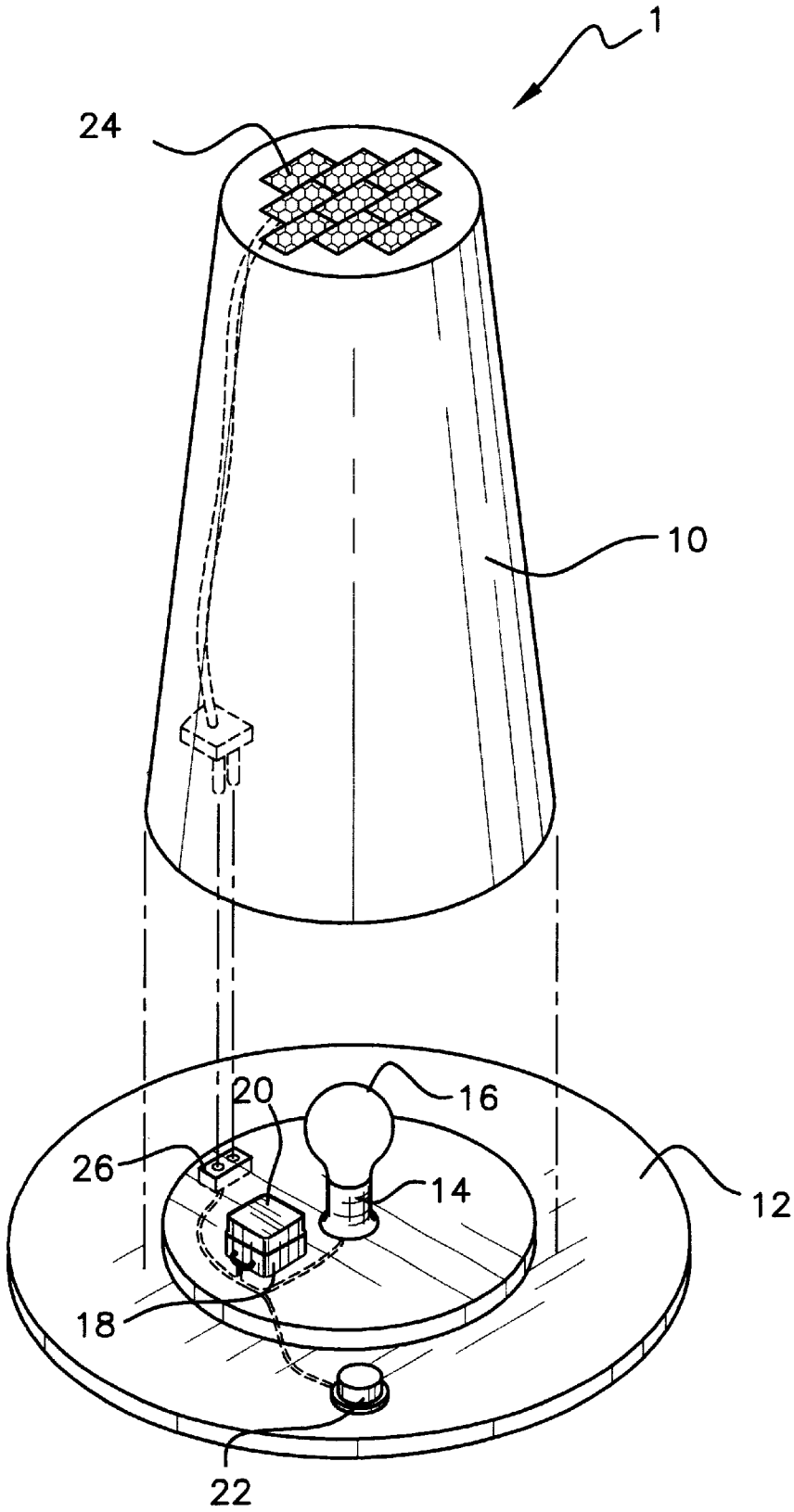
FIG. 2 is an exploded environmental perspective of the invention.

Referring to FIGS. 1 & 2, in its preferred embodiment, pylon 1 is composed of drum 10, and base 12.

Drum 10 is hollow, generally frusto-conical in shape, with a slightly smaller diameter at its closed top end than at its open bottom end, such that a number of drums 10 can be stacked when not in use. Drum 10 is composed of a translucent plastic material that has sufficient rigidity to be self supporting and shape retaining while sufficiently resilient to absorb the impacts and occasional crushing of vehicular traffic. It would be evident to one skilled in the art, that drum 10 could be of a variety of shapes, such as cylindrical, conical or rectangular and that drum 10 could be used to display illuminated signs such as company logos or advertising.

Base 12 is of dimensions slightly greater than is the open lower end of drum 10 and is composed of an impact absorbent plastic of sufficient weight to render pylon 1 stationary under normal conditions. It would be evident to one skilled in the art that base 12 could be further weighted by providing a fill hole and cap (not shown) for the addition of sand or water as ballast or providing an additional weighted ring that could be slipped around the perimeter of drum 10. The center portion of base 12 is raised with a diameter such that the interior of drum 10 can be snugly fitted over the raised portion of base 12 to secure drum 10 to base 12 by friction. It would be evident to one skilled in the art, however, that various devices, such as a threaded connection or bayonet locking system, could be used to provide a more secure connection between drum 10 and base 12.

Formed into the raised center portion of base 12 is a mounting bracket 14 for light source 16 and battery bracket 18 for power source 20, typically a battery. Light source 16 is activated by switch 22 which is placed in electrical connection line between power source 20 and light source 16. It would be evident to one skilled in the art that switch 22 could be manually, photo or motion sensitively, infra-red, or timer activated. Likewise, it would be evident to one skilled in the art that switch 22 could be an intermittent switch allowing flashing illumination. Optional photo-voltaic cells 24 could be mounted in the top surface of drum 10 with a connection to base 12 at plug 26 to recharge power source 20 during daylight hours. It would be further evident to one skilled in the art that switch 22 could be mounted in the wall or top of drum 10 rather than in base 12.

It would be evident to one skilled in the art that a battery and light source could be manufactured independently of drum 10 and base 12 which could be used in the base of any translucent pylon.

It would also be evident to one skilled in the art that drum 10 or light source 16 could be of a variety of colors for use in differing situations.

Figure 3:
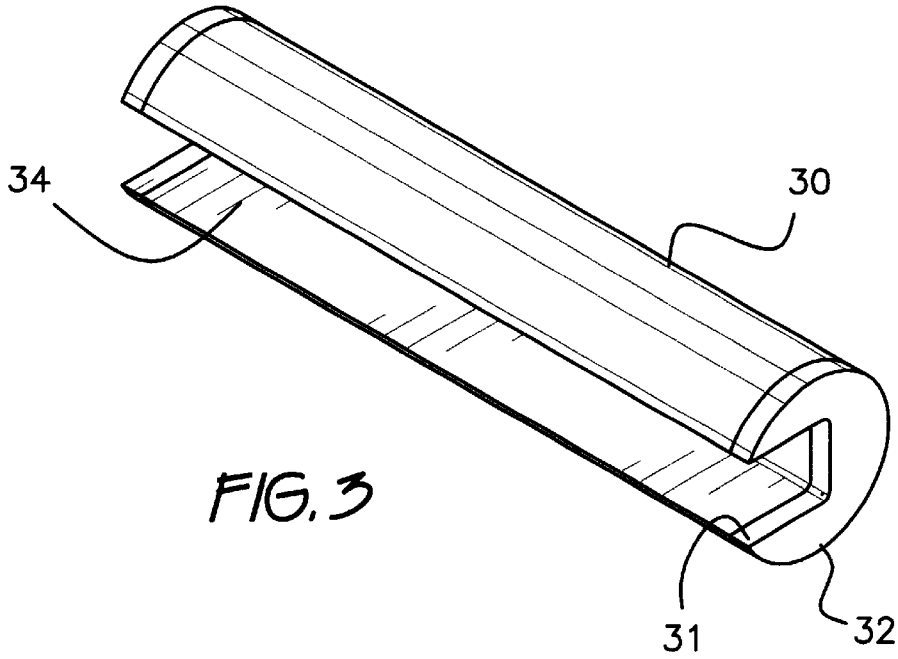
FIG. 3 is an environmental perspective of a second embodiment of the invention.
Figure 4:
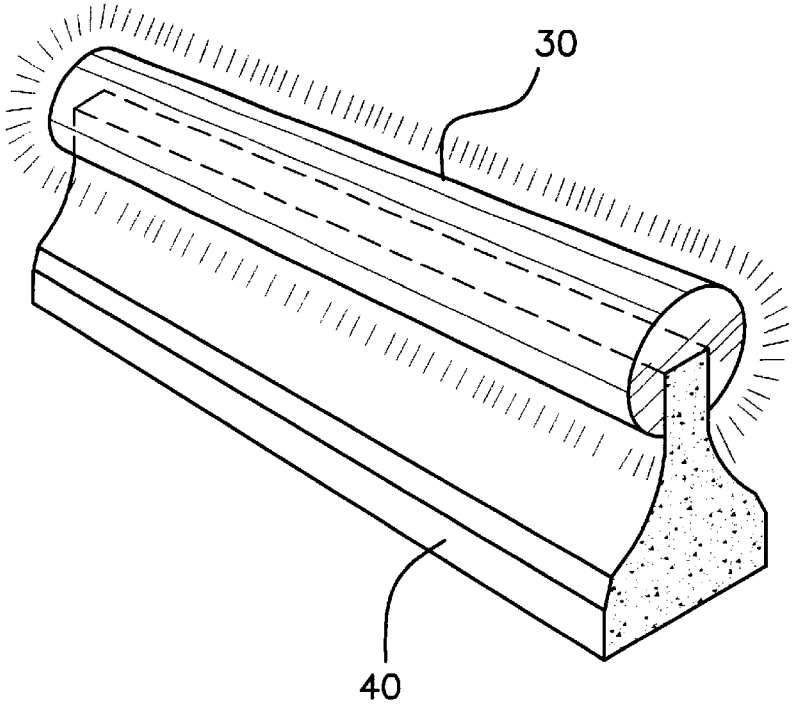
FIG. 4. is an environmental perspective of the second embodiment of the invention in use with a trestle type barricade.
Figure 5:
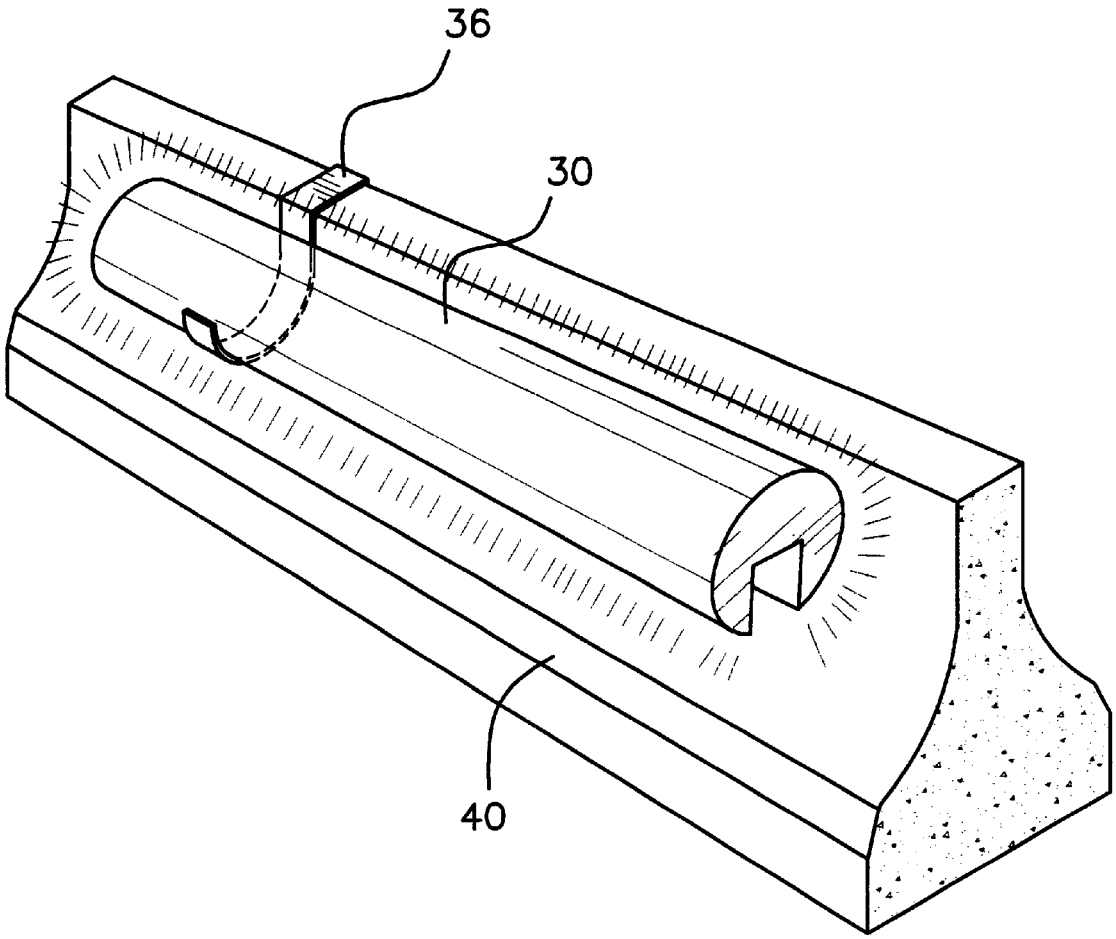
FIG. 5 is an environmental perspective of a third embodiment of the invention.

Referring to FIGS. 3 & 4, in a second embodiment, the invention is composed of a more slender cylindrical tube 30, closed at one end and open at the opposite end, and light weight notched base 32 with battery and light source mounted similarly to the preferred embodiment. Tube 30 is molded with a groove 34 along its length. Groove 34 engages with notch 31 in notched base 32 such that tube 30 and notched base 32 could be mounted atop a trestle barricade 40 or other type of barricade. Alternatively, an elongate tube 30, formed with or without a groove, could be affixed to trestle barricade 40 using mounting clips 36, as in FIG. 5. It would be evident to one skilled in the art that elongate tube 30 could be open at both ends such that a battery and light source could be mounted at both ends of the tube. It would also be evident to one skilled in the art that the method of mounting tube 30 to a barricade could vary greatly, as could the types of barricades to which tube 30 could be mounted.

It is to be understood that the present invention is not limited to the embodiments described above, but encompasses any and all embodiments within the scope of the following claims.

What is claimed is:

1. A safety marker pylon, comprising a hollow element composed of a translucent material and having a lower end; a base which is connected with said hollow element by snugly fitting said lower end of said hollow element on a portion of said base; a light source with a power source arranged on said base and providing internal illumination of said hollow element so that light is emitted through walls of said hollow element; switch means for controlling power of said power source, said base being connected removably with said lower end of said hollow element so that said hollow element can be easily removed from said base by pulling said hollow element upwardly from said base and thereby in the event if said hollow element is damaged and if it is necessary to recharge said power source, upon removal of said hollow element said base can be connected with another hollow element if the first mentioned hollow element is damaged or said base can be connected with a charging source to recharge said power source.

2. A safety marking pylon as defined in claim 1, wherein said base is formed as a circular disc with a diameter which is significantly greater than a diameter of said lower end of said hollow element so as to provide a sturdy support for said hollow element, said base also having a raised portion extending from said circular disc and having a smaller diameter so that said lower end of said hollow element is snugly fitted over said raised portion.

3. A safety marking pylon as defined in claim 1, wherein said switch means is formed as an automatic switch selected from the group consisting of a photo-sensitive switch, a timer switch, a motion-sensitive switch and an infrared switch which automatically switch on said power source.

4. A safety marking pylon as defined in claim 1; and further comprising a photo-voltaic cell which is connected with said power source so as to recharge said power source under the action of light acting on said photo-voltaic cell and thereby provide an automatic recharge of said power source.

5. A safety marking pylon, comprising a hollow element composed of a translucent material; a light source with a power source arranged in said hollow element so that light emitted by said light source passes through walls of said hollow element, said translucent element being formed as a translucent tube halving a groove extending over a length of said tube so as to fit snugly over a trestle barricade.

6. A safety marking pylon as defined in claim 5; and further comprising a base formed as a notched end cap over which said tube snugly fits and also provided with a groove for snugly fitting over the trestle barricade.

7. A safety marking pylon, comprising a hollow element composed of a translucent material; a light source with a power source arranged in said hollow element so that light emitted by said light source passes through walls of said hollow element, said hollow element being formed as a translucent tube having a groove extending over a length of said tube so as to fit snugly over a trestle barricade, and further comprising a base formed as a notched end cap over which said tube snugly fits and also provided with a groove for snugly fitting over the trestle barricade.

* * * * *